US005405706A

United States Patent [19]

Kirkwood et al.

[11] Patent Number: 5,405,706

[45] Date of Patent: Apr. 11, 1995

[54] SILICA-ENRICHED PROTECTIVE COATING

[75] Inventors: Brad L. Kirkwood, Kent; Elizabeth M. W. Pincha, Normandy Park, both of Wash.

[73] Assignee: The Boeing Company, Seattle, Wash.

[21] Appl. No.: 146,586

[22] Filed: Dec. 3, 1993

Related U.S. Application Data

[62] Division of Ser. No. 228,637, Aug. 3, 1988.

[51] Int. Cl.[6] ..... B22F 3/00; B32B 15/00; B32B 9/04

[52] U.S. Cl. ..... 428/547; 428/691; 428/331; 428/335; 428/446

[58] Field of Search ..... 428/547, 641, 331, 335, 428/446

[56] References Cited

U.S. PATENT DOCUMENTS

| | | | |
|---|---|---|---|
| 4,034,142 | 7/1977 | Hecht | 428/678 |
| 4,369,233 | 1/1983 | Van Schaik | 428/678 |
| 4,371,570 | 2/1983 | Goebel et al. | 427/248.1 |
| 4,374,183 | 2/1983 | Deadmore et al. | 428/641 |
| 4,419,416 | 12/1983 | Gupta et al. | 428/656 |
| 4,584,340 | 4/1986 | Chi | 524/596 |
| 4,925,740 | 5/1990 | Norris et al. | 428/547 |

*Primary Examiner*—Peter A. Nelson
*Attorney, Agent, or Firm*—John C. Hammar

[57] ABSTRACT

Coatings which protect the skin of hypersonic flight vehicles are disclosed. Silicide coatings, such as R512E, is used to minimize catalytic recombination of dissociated species, such as atomic oxygen and atomic nitrogen, thus, decreasing thermal and oxidative degradation. Prehydrated, polymerized sol of tetraethylorthosilicate is applied to a coating, and is fired, to produce an integral protective coating.

6 Claims, 2 Drawing Sheets

SILICA-ENRICHED PROTECTIVE COATING

REFERENCE TO RELATED APPLICATIONS

The present application is a divisional application based on U.S. patent application Ser. No. 07/228,637, filed Aug. 3, 1988.

TECHNICAL FIELD

The present invention relates to silicon-based coatings applied to the skin of hypersonic flight vehicles to protect against thermal and chemical degradation of the skin.

BACKGROUND OF THE INVENTION

The metals which are used on the skin of hypersonic flight vehicles are susceptible to oxidative and thermal degradation during flight. The skin is exposed high temperatures and low pressures which cause unprotected metal surfaces to oxidize and volatilize during flight, leading to rapid failure. It is desirable to construct a skin which possesses high emittance for high reradiation and low volatility to prevent loss of the skin during flight. Refractory metals, such as columbium and molybdenum, are typically used; however, these metals are still susceptible to oxidative and thermal degradation.

In addition to being exposed to high temperatures and low pressures during flight, the leading regions of hypersonic flight vehicles are exposed to an ionized gas stream with dissociated species of atomic oxygen and atomic nitrogen. Uncoated refractory metals catalyze the recombination of the dissociated gases on the metal surfaces during hypersonic ascent and reentry of the flight vehicle. The heat of reaction produced by the recombination of the dissociated species further increases the temperature of the skin, and therefore, increases the probability of failure.

In the prior art, others have developed coatings which are applied to the metal skin to protect the metal from oxidation. Such coatings include intermetallic and silicide-based coatings, such as R512E, or Hf—Cr—Si. These prior art coatings have proven only partially successful in protecting the skin from surface oxidation, and there has been no showing that the coatings protect the metal surfaces from catalytic recombination. Furthermore, prior art coatings are also known to volatilize in the low pressure and high temperature environments during flight. If the coating volatilizes, the metal is left unprotected, and major repair must be undertaken, which is costly and time-consuming. It is, therefore, desirable to develop a coating having high emittance, and which protects the metal skin, particularly the leading edges, from degradation, and exhibits low catalytic recombination performance. It is also desirable to develop a facile, inexpensive method for maintaining the silica protective coating.

SUMMARY OF THE INVENTION

The present invention discloses a silica-enriched coating which protects the skin of hypersonic vehicles, which said coating has low catalytic recombination performance. The coating is a silicon and metal based intermetallic coating for coating refractory metals, such as R512E or Hf—Cr—Si. The use of such a coating on the skin of hypersonic vehicles, particularly the leading edges, minimizes degradation due to catalytic recombination of dissociated species and the attendant heat of reaction.

The present invention also discloses a silica-enriched secondary coating for the skin of hypersonic flight vehicles, which is applied to a primary silicon and metal based intermetallic coating. The secondary coating is prehydrated, polymerized tetraethylorthosilicate (TEOS) in an alcohol or water solution. After applying the primary and secondary coatings, the coated surface is fired to produce a silica-enriched integral protective layer. Said firing may occur during flight.

After having been fired, the thickness of the silica-enriched integral protective layer is approximately 0.0001 to 0.0005 inch. The protective layer is viscoelastic, thus helping to prevent cracking or spalling, and to prevent "pest" oxidation during the heat up of cool down portions of the flight cycle.

The present invention further includes a method for maintaining the silica content of a silica and metal based protective coating applied to the skin of a hypersonic flight vehicle. The method includes the steps of: applying a coating of silica sol which is comprised of prehydrated, polymerized tetraethylorthosilicate (TEOS) in an alcohol or water solution to the surface of a flight vehicle, to which a silicide or intermetallic coating has already been applied. The silica sol coating may be applied, for example, by spraying or dipping. The coating is then subjected to heat at about 400–700 degrees F. to drive of the solvent and other volatiles and to allow gellation allowed to proceed. The silica sol coating is then fired to at about 1000–2000 degrees F., during flight or with heating to allow condensation and formation of a glass layer.

The method of the present invention may be practiced on site, thus minimizing down time and the expense of repair. The silica sol may be applied, i.e., by spraying, and then heated to evaporate the solvent and volatiles, for example with a heat lamp. The high temperature firing may then take place during flight, or with additional heating, for example, with a heat lamp.

According to the method of the present invention, the thickness of the integral protective layer after the step of high temperature firing may be approximately 0.0001 to 0.0005 inch. Further, after the high temperature firing, the protective layer is a viscoelastic glass layer which is resistant to cracking or spalling, and to "pest" oxidation.

PREFERRED EMBODIMENT

Figure 1:
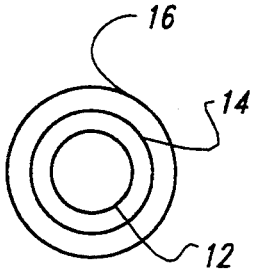
FIG. 1 shows schematically the coatings of the present invention.
Figure 2:
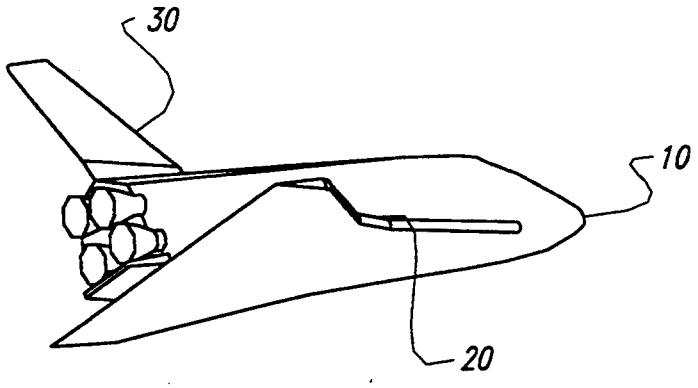
FIG. 2 shows the leading edges of a hypersonic flight vehicle that are particularly prone to degradation.

The following discussion of the preferred embodiments will refer to FIGS. 1 and 2, described briefly above.

The present invention discloses silica rich coatings for the skin of hypersonic flight vehicles. In the first preferred embodiment, the coating has low surface catalytic performance, that is, its performance as a catalyst to the recombination of dissociated species, such as oxygen and nitrogen, is low. It also has high emittance and protects the skin of the flight vehicle from oxidation. Preferably the coating is selected from the group of coating consisting of silicides and intermetallics, such as R512E.

In another preferred embodiment, the silica rich coating has a primary silicon and metal based coating 14, applied to the skin 12 of the flight vehicle. The primary coating is selected from the group of coatings consisting of silicides and intermetallics, such as R512E. A secondary coating 16 is applied to the primary coating by applying silica sol which is made of prehydrated, polymerized tetraethylorthosilicate (TEOS) in an alcohol or water solution. The silica sol is applied, for example, by spraying or dipping, and is then subjected to heating at approximately 400–700 degrees F. in order to drive off solvent and volatiles, such as $CO_2$, $H_2O$, and $CH_4$, and is then subjected to high temperature heating at approximately 1000–2000 degrees F. to allow polymerization and condensation to form a viscoelastic glass coating. The high temperature heating may occur during flight of the hypersonic vehicle, or may be completed with external heating sources, such as heat lamps.

One advantage to the method of the present invention is that the silica content of the coating on the hypersonic flight vehicle may be maintained and the coating may be repaired in the field. It is not necessary to use prior methods of dissembling the flight vehicle and transporting the dissembled portions to a distant location for repair. Instead, the coating may be repaired on site, i.e., by applying the silica sol, heating the coating to approximately 400–700 degrees F. to allow for evaporation, and then allowing the high temperature heating to proceed during flight. After the high temperature heating (about 1000–2000 degrees F.) the secondary coating and primary coating together form an integral coating. Preferably, the integral coating has a thickness of approximately 0.0001 to 0.0005 inch after the high temperature heating.

The protective coating of the present invention is particularly useful when applied to the leading edges of a hypersonic flight vehicle, where stagnation heating occurs, including the nose cone 10, the leading edges of the wings 20, and the rudder 30. These leading edges are exposed to the dissociated species of atomic oxygen and atomic nitrogen in the shockwave during hypersonic ascent and reentry.

After the silica sol coating is applied, it reacts with the primary coating during the steps of firing. During firing, the organic volatiles of the sol are evaporated and the silica layer becomes a non-porous layer. It also reacts with the silica present in the silicide primary coating to enhance the surface silica of the system. The silica sol coating integrates with the primary coating to produce an impermeable and impenetrable layer. The leading surfaces 10, 20, and 30 are changed to silica-enriched surfaces. Catalytic recombination is reduced and further chemical changes in the primary coating are inhibited. The silica-enriched coating also provides oxidation protection to the vehicle skin at elevated temperatures by virtue of its viscous flow. It seals any flaws and asperities present in the primary coating surface and metallic substrate surface.

EXAMPLE 1

A prehydrated, polymerized tetraorthosilicate (TEOS) sol (5%, by weight) in alcohol was prepared. The silica sol was applied to an article whose surface had been coated with a primary coating described above. The silica sol was applied by spraying. Firing at 400 degrees, then at 1200 degrees F. converted the gelled sol into a ceramic coating by removal of the organic volatiles and structural rearangement densification resulting in a pure silica coat.

EXAMPLE 2

A 3.0" diameter by 0.030" thick disc of columbium alloy, was coated with the primary coating, R512E. This test article had thermocouples bonded to its back surface. It was mounted in an appropriate high temperature plasma arc jet holder, and inserted into a plasma that had a temperature greater than 2500° F., a high Mach velocity, and a low pressure. A plasma arc jet facility simulates the environment of a hypersonic vehicle atmospheric reentry, i.e., the temperature, the (near vacuum) low pressure, high velocity, and most important the dissociated species of atomic oxygen and atomic nitrogen. This dissociation exists behind the bow shockwave on the frontal surface of the test article, which represents the frontal surface of a nose cone on the hypersonic vehicle.

Figure 3:
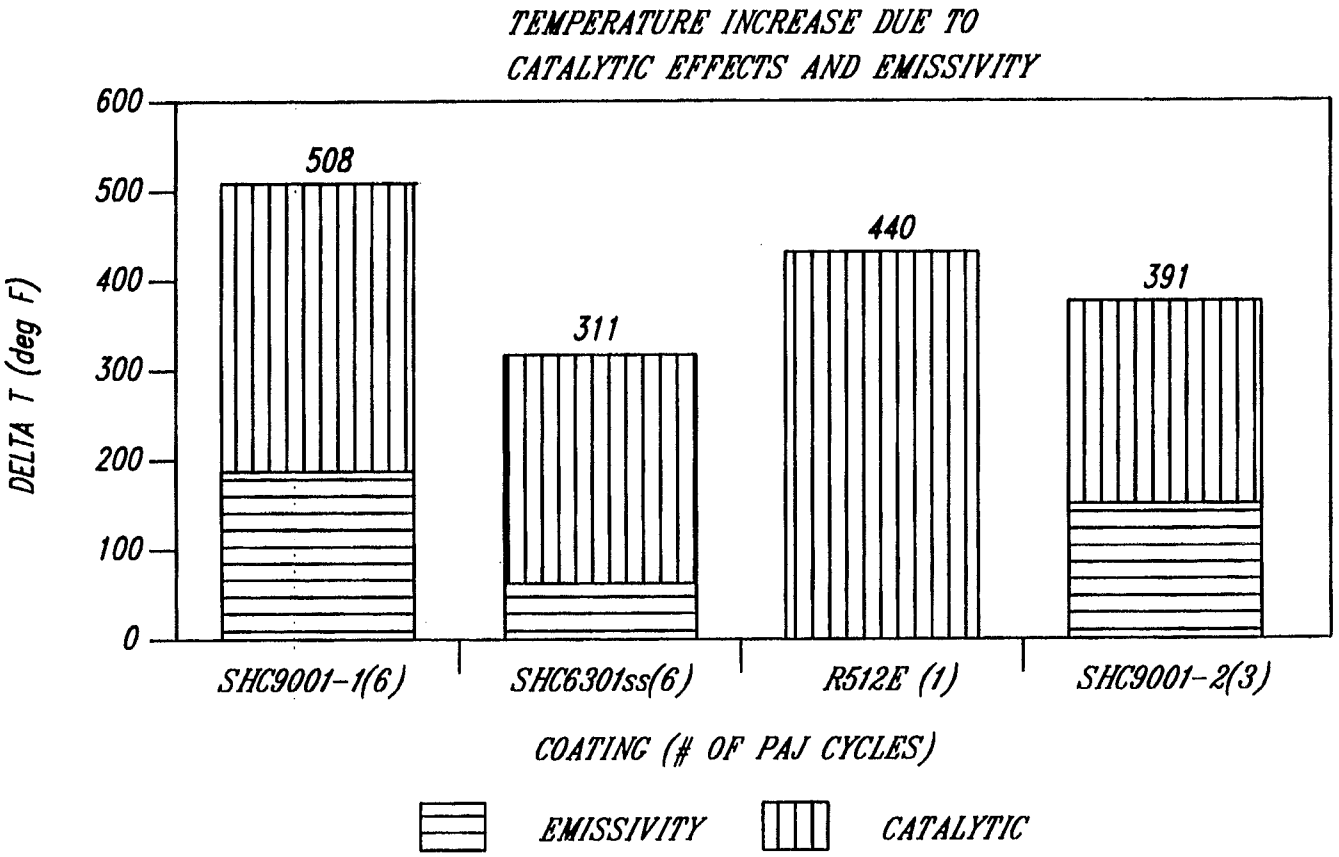
FIG. 3 shows the test results discussed in Example 2 below.

These test results from the plasma arc jet runs, shown on FIG. 3, for the various coated columbium alloy test articles are compared to the experimentally-evaluated Shuttle tile, i.e., Reaction Cured Glass (RCG) black coating. Any differential temperature increases of the test surface were from the combined sources of surface emittance and surface catalytic efficiency. Emittance is an optical property of a surface. A high emissivity, i.e., 0.9 (on the RCG) (max. is 1.0), will reradiate a large amount of heat form the surface. Unprotected surfaces of metal possess high potential to recombine with atomic (free) oxygen available in the dissociated species, and this heat of recombination increases the temperature of the metallic surface. The test results of three different coatings, R512E, SHC9001, and SHC6301ss, show that the low catalyic efficiency of the silica sol (ss) on SHC6301ss had the least combined increase in temperature, although not in the catalytic effect. The enhanced presence of the silica sol on SHC6301ss maintained its high emissive surface. The SHC9001 coating had the highest silicon content and a higher emissivity, and thus would and does have the lowest temperature increase due to catalytic effect. Since the R512E had an identical emissivity as the Reaction Cured Glass, with the silica sol secondary coating to replace the volatilized silica, the probability of a much lower catalytic efficiency would be realized.

From the foregoing, it will be appreciated that, although embodiments of the invention have been described herein for purposes of illustration, various modifications may be made without deviating from the spirit and scope of the invention. Accordingly, the invention is not limited except as by the appended claims.

We claim:

1. A silicon-enriched coating for the skin of flight vehicles, comprising:

a primary, silicon-based protective coating, applied to the skin; and, a secondary coating applied to the first, silicon-based protective coating, said second coating further comprised of prehydrated, polymerized tetraethylorthosilicate (TEOS), said primary and secondary coating having been fired to produce a silicon-enriched integral protective layer.

2. The coating of claim 1 wherein after having been fired, the thickness of the silicon-enriched integral protective layer is approximately 0.0001 to 0.0005 inch.

3. The coating of claim 1 wherein the primary coating is a silicide or intermetallic.

4. The coating of claim 3 wherein the intermetallic is a Hf—Cr—Si.

5. The coating of claim 1 being a viscoelastic glass.

6. The coating of claim 1 wherein the TEOS is applied as a sol.

* * * * *